US009207642B2

(12) United States Patent
Willemin et al.

(10) Patent No.: US 9,207,642 B2
(45) Date of Patent: Dec. 8, 2015

(54) TIMEPIECE ABLE TO INDICATE THE SUNRISE OR SUNSET ANYWHERE IN THE WORLD

(71) Applicant: The Swatch Group Research and Development Ltd, Marin (CH)

(72) Inventors: Michel Willemin, Prêles (CH); Beat Gilomen, Grenchen (CH); Dominique Lechot, Reconvilier (CH)

(73) Assignee: The Swatch Group Research and Development Ltd, Marin (CH)

( * ) Notice: Subject to any disclaimer, the term of this patent is extended or adjusted under 35 U.S.C. 154(b) by 0 days.

(21) Appl. No.: 14/604,901

(22) Filed: Jan. 26, 2015

(65) Prior Publication Data

US 2015/0234357 A1 Aug. 20, 2015

(30) Foreign Application Priority Data

Feb. 20, 2014 (EP) ..... 14156008

(51) Int. Cl.
*G04B 19/26* (2006.01)

(52) U.S. Cl.
CPC ..... *G04B 19/262* (2013.01)

(58) Field of Classification Search
CPC ..... G04B 19/00; G04B 19/26; G04B 19/262; G04B 19/226; G04B 19/22
USPC ..... 368/16–17
See application file for complete search history.

(56) References Cited

U.S. PATENT DOCUMENTS 402,006 A * 4/1889 Deichmann ..... H01M 2/18 429/136
4,583,864 A * 4/1986 Graves ..... G04B 45/0061 368/16
4,714,351 A * 12/1987 Domen ..... G09B 27/08 368/17
4,740,931 A * 4/1988 Graves ..... G04B 19/26 368/17
4,761,138 A * 8/1988 Niesyn ..... G09B 27/02 434/136
5,197,043 A 3/1993 Strader
5,457,663 A * 10/1995 Mejaski ..... G04B 19/26 368/15
7,012,855 B1 * 3/2006 Loaiza ..... G04B 319/226 368/17
8,837,260 B2 * 9/2014 Zaugg ..... G04B 19/262 368/10

FOREIGN PATENT DOCUMENTS

CH 705 722 A1 5/2013
WO 02/082191 A1 10/2002

OTHER PUBLICATIONS

European Search Report of EP14156008, Nov. 12, 2014.

* cited by examiner

*Primary Examiner* — Sean Kayes
(74) *Attorney, Agent, or Firm* — Sughrue Mion, PLLC

(57) ABSTRACT

The timepiece includes sunrise and sunset indicating means taking account of seasonal variations, said means include a sphere reproducing the terrestrial globe, a shell arranged concentrically to the sphere and arranged to demarcate one portion of the terrestrial globe where it is night from another portion where it is day by indicating the position of the earth's terminator. The sphere is arranged to be driven by the movement so as to rotate at the rate of one revolution per 24 hours about a first axis of rotation oriented parallel to the plane of the dial, and the shell is mounted to pivot about a second axis perpendicular to the plane of the dial. The sunrise and sunset indicating means also include an annual cam arranged to be driven in rotation by the movement at the rate of one revolution per year, the cam having a profile representative of the tilt of the sun relative to the equatorial plane.

13 Claims, 6 Drawing Sheets

TIMEPIECE ABLE TO INDICATE THE SUNRISE OR SUNSET ANYWHERE IN THE WORLD

This application claims priority from European patent application No. 14156008.6 filed Feb. 20, 2014, the entire disclosure of which is hereby incorporated herein by reference.

FIELD OF THE INVENTION

The present invention concerns a timepiece including a dial, a timepiece movement and means of indicating the sunrise and sunset taking account of seasonal variations, said means including a sphere reproducing the terrestrial globe, a shell arranged concentrically to the sphere and arranged to demarcate a portion of the terrestrial globe where it is night from another portion where it is day by indicating the position of the earth's terminator, the sphere being arranged to be driven by the movement so as to rotate at the rate of one revolution per 24 hours about a first axis of rotation (X-X) corresponding to the polar axis of the terrestrial globe, and the shell being mounted to pivot about a second axis (Y-Y) perpendicular to the first axis (X-X) and intersecting the first axis substantially at the centre of the terrestrial globe.

PRIOR ART

The duration of the day is the time comprised, each day, between the moment when the upper limb of the sun appears above the horizon in the east, at sunrise, until it disappears below the horizon in the west, at sunset. Whatever the time, there is always one half of the surface of the globe which is illuminated by the sun and another half which is in darkness. The earth's terminator is the line of demarcation between the portion of the earth which is illuminated and that which is in darkness. Geometrically speaking, the earth's terminator is a large circle which encircles the terrestrial globe. This large circle extends in a plane perpendicular to the plane of the earth's orbit around the sun (called the ecliptic plane). It may also be noted that the centre of the earth is on the line of intersection between these two planes.

Generally, the duration of the day varies throughout the year and depends on latitude. This variation is caused by the tilt of the axis of rotation of the earth on itself relative to the ecliptic plane. This tilt by definition corresponds to the latitude of the tropics which is ±23° 27'. As is well known, the duration of the day is shortest at the December solstice in the Northern Hemisphere, and at the June solstice in the Southern Hemisphere. At the equinoxes, the duration of day and night are equal everywhere on earth.

There are already known timepieces corresponding to the definition given in the above preamble. FIG. 3 of the German Utility Model DE7014354 (U), in particular, discloses a table clock including a sphere that reproduces the terrestrial globe and which is mounted on a vertical axis to rotate above a case-like support. The upper face of the support has an annular dial arranged concentrically to the axis of the sphere and featuring a 24 hour circle. A timepiece movement housed inside the support is provided for rotating the terrestrial globe above the dial at the rate of one revolution per 24 hours. This known table clock further includes a hemispherical shell that is slightly larger than the terrestrial globe and mounted concentrically thereto so as to surround the globe and only reveal half of it. The hemispherical shell is arranged to make it possible to distinguish, on the terrestrial globe, between a half sphere illuminated by the sun and another which is in darkness. The hemispherical shell is also hinged on two vertical columns on either side of the earth. It can therefore pivot about a horizontal axis which intersects the vertical axis which carries the globe at the centre thereof. The shell is also fitted with a rack arranged to cooperate with a pinion forming part of a mechanism provided for controlling the angle of tilt of the shell so that the entire range of values between − and +23.5° is covered by this angle, once a year in one direction and then in the other, to reproduce the effect of the variation in tilt of the sun above the equator with the seasons.

Although satisfactory for a table clock, the construction described in the aforementioned prior art document is not very well suited to a watch intended to be carried on the person. Indeed, the sphere that reproduces the terrestrial globe must be sufficiently large for it to be easy to identify, at least approximately, any location in the world. However, the limited space between the dial and a watch crystal means that the globe used must be of small dimensions. To reduce the height required for the globe, it is, of course, possible to arrange an aperture in the form of a recess in the dial to accommodate the sphere. However, this type of arrangement limits visibility, since it is then only the hemisphere placed at the top which is visible (this may, in theory, be the Southern Hemisphere as well as the Northern Hemisphere. However, in the conventional case, it is the North Pole which is oriented upwards). One solution might be to propose two different watches: one intended for people living in the Southern Hemisphere and the other for those living in the Northern Hemisphere. However, a problem would arise for travellers who pass from one hemisphere to the other.

BRIEF SUMMARY OF THE INVENTION

It is an object of the present invention to overcome the drawbacks of the prior art that have just been described. This object is achieved by providing a timepiece in accordance with the annexed claim 1.

According to the invention, the terrestrial globe is positioned on its side (the line which passes through the two poles is parallel to the plane of the dial). One advantage of this arrangement is that almost the entire surface of the globe can be seen, even if the sphere is housed in a recess and is mostly situated underneath the level of the dial. Indeed, when the terrestrial globe is driven in rotation, the various regions pass in succession over the dial. Further, according to the invention, the globe can be held by two pivots at the two poles, which makes the construction more robust. It cannot be denied that with this arrangement, the regions of the two poles are likely to be partially concealed. However, this is a lesser evil given that the poles correspond to the least populated latitudes of the earth.

Again according to the invention, the shell provided for demarcating night from day is pivoted about an axis of rotation perpendicular to the dial. One advantage of this arrangement is that the earth's terminator is centred relative to the globe. The boundary between day and night thus achieves optimum visibility. Another interesting effect of the combination according to the invention of a globe positioned on its side and a vertically pivoted shell is that the portion of the earth's terminator visible above the dial indicates either the places where the sun is rising, or the places where the sun is setting. As a result of this feature, it is possible to provide either a timepiece indicating the places where the sun is rising or a timepiece indicating the places where the sun is setting.

BRIEF DESCRIPTION OF THE DRAWINGS

Other features and advantages of the invention will appear upon reading the following description, given solely by way of non-limiting example, with reference to the annexed drawings, in which.

DETAILED DESCRIPTION OF ONE EMBODIMENT

Figure 1:
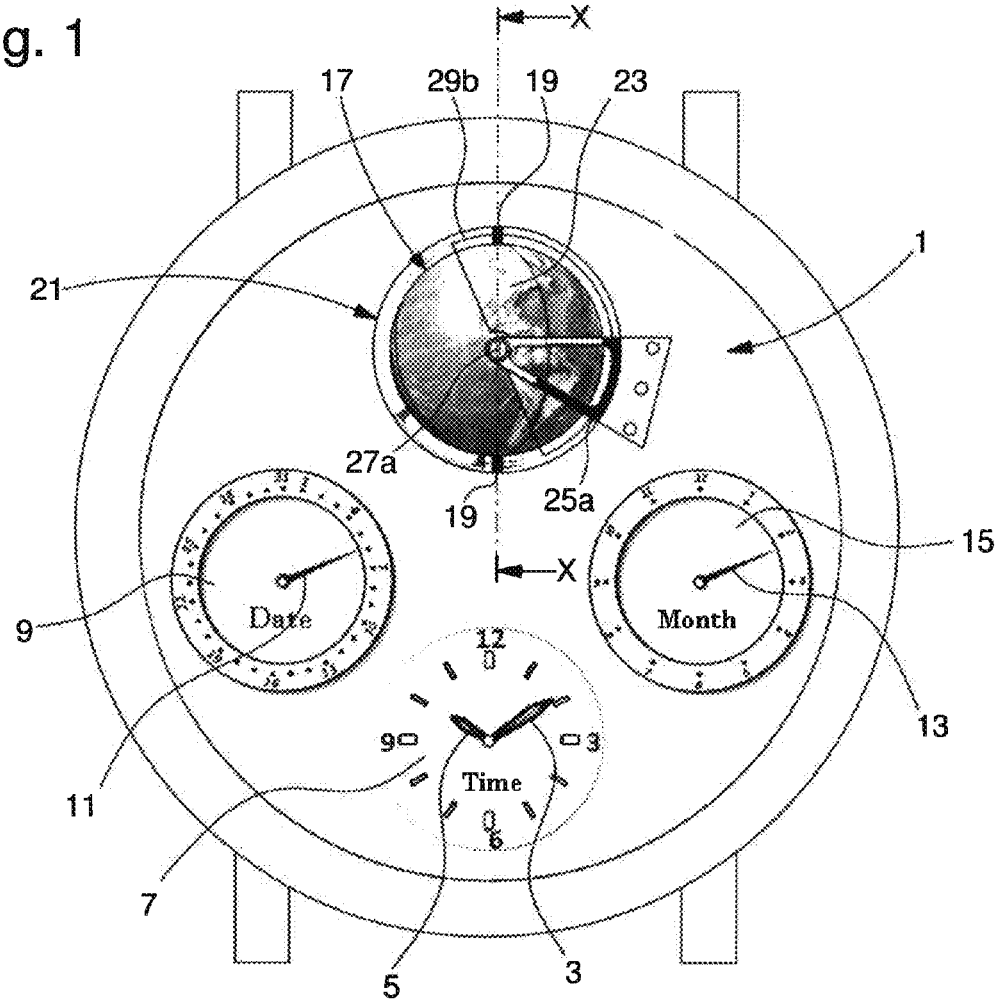
FIG. 1 is a plan, top view of wristwatch according to a particular embodiment of the invention.
Figure 2:
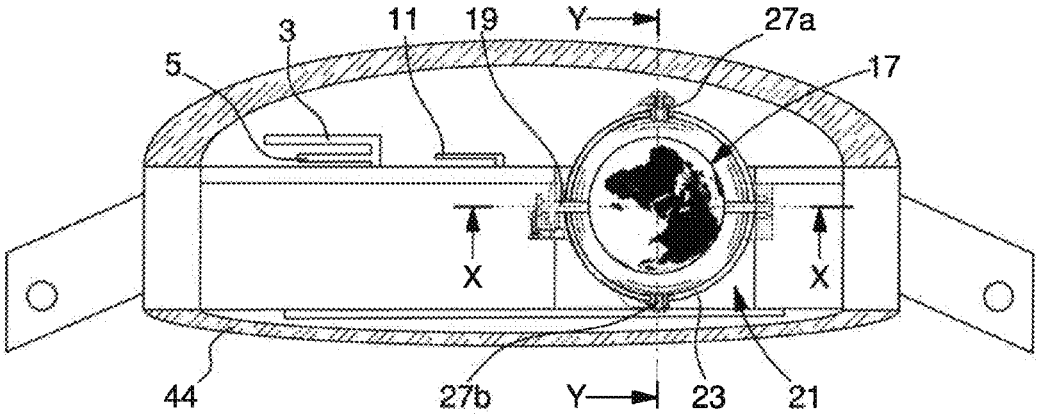
FIG. 2 is a schematic cross-section of the watch of FIG. 1.

The watch illustrated in FIGS. 1 and 2 includes, in particular, a main dial designated as a whole by the general reference numeral 1. The main dial carries three small dials (referenced 7, 9 and 15) to provide the user of the watch with various information. First of all there is the time, which is indicated by a minute hand 3 and an hour hand 5, arranged to rotate in a conventional manner relative to the first small dial 7. The illustrated watch also includes a calendar whose display uses the two other small dials 9, 15. This calendar will not be described in detail since it is not the subject of the invention. Suffice it to say that the calendar display (from 1 to 31) (or date) is provided by a small hand 11 arranged to rotate above small dial 9, and that another small hand 13 is arranged to provide an indication of the month of the year in cooperation with the third small dial 15.

According to the invention, the watch which is the subject of the present example also includes means of indicating the sunrise and sunset at different locations on earth taking account of seasonal variations. In this regard, the watch of FIGS. 1 and 2 also includes a sphere 17 which represents the terrestrial globe. It can be seen that sphere 17 is mounted on a through arbor 19 which is arranged concentrically to the polar axis (X-X) of the terrestrial globe. Arbor 19 is oriented parallel to the plane of the dial, and its two ends are engaged in two bearings (not referenced) carried by the frame, so as to allow the sphere to rotate about the polar axis (X-X). In the illustrated example, the sphere is housed in a circular recess 21 arranged at 12 o'clock in the dial. It can also be seen that the polar axis X-X of the globe is superposed on the 12 o'clock-6 o'clock axis of the watch. In a conventional manner, the north pole of the globe is oriented upwards (in the direction of 12 o'clock).

According to the invention, the means for indicating sunrise and sunset at different locations on the earth also include a shell 23 which is arranged concentrically to sphere 17 and which is arranged to enable a portion of the terrestrial globe where it is night to be distinguished from another where it is day. In the illustrated example, shell 23 has the general shape of a hollow half sphere which surrounds one half of the terrestrial globe. The shell may, for example, be made of a translucent or transparent material which is preferably slightly tinted, to give the impression that the portion of the globe covered by the shell is in darkness.

According to the invention, shell 23 is arranged to pivot about an axis of rotation (Y-Y) oriented perpendicularly to the plane of dial 1 (this axis is called hereafter the "ecliptic axis"). In the illustrated example, the shell carries two pivots which are fixed at diametrically opposite locations on the edge thereof. The Figures also show two bridges 25*a*, 25*b* located on either side of the terrestrial globe, one above and the other underneath dial 1. These two bridges (referred to hereafter as "terminator bridges") carry two bearings into which the two pivots integral with shell 23 are inserted and held. The two hinges, each formed by fitting one of the pivots of the shell into the corresponding bridge bearing (25*a* or 25*b*), are respectively referenced 27*a* and 27*b* in the Figures. It can be seen that bridges 25*a*, 25*b* each have the shape of a small isosceles triangle pierced with openings and wherein one of the apexes carries the bearing. This apex extends cantilevered in the direction of the centre of recess 21 in the dial, so that the two hinges 27*a*, 27*b* are aligned along the ecliptic axis at the centre of recess 21.

Figure 3A:
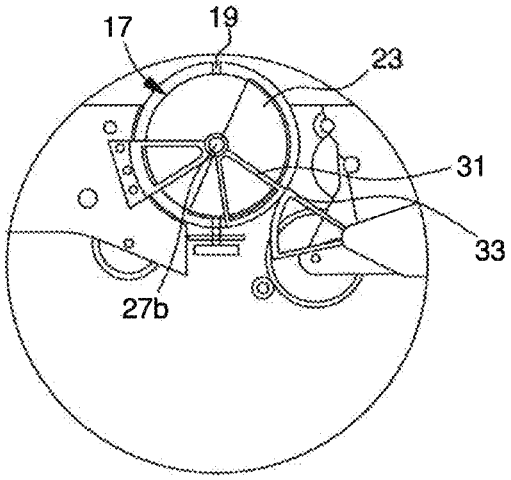
FIG. 3A is a schematic, plan, bottom view showing a main plate on which are mounted the means of indicating the sunrise and sunset according to the invention, the shell being shown in the position that it occupies on 21 June (summer in the Northern Hemisphere).
Figure 3B:
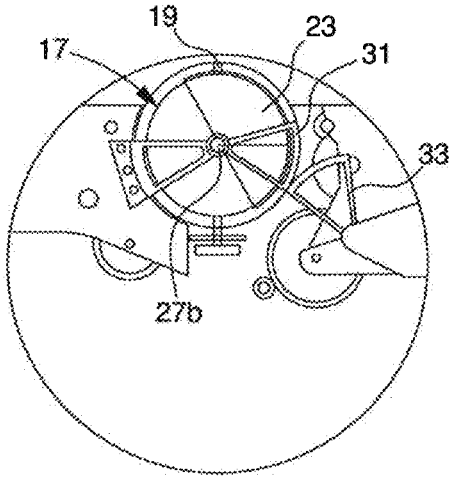
FIG. 3*b* is a schematic view similar to that of FIG. 3A, but with the shell shown in the position that it occupies on 21 December (winter in the Northern Hemisphere).

Referring more particularly now to FIGS. 3*a* and 3*b*, it can be seen that shell 23 also carries a rack 31 integral with one of the pivots on hinge 27*b*. The toothed sector of rack 31 meshes with the toothed sector of a second rack 33 which forms part of a mechanism which will be described below and which is provided for controlling the pivoting of the shell about the ecliptic axis (Y-Y), so as to tilt it relative to the polar axis (X-X) of the terrestrial globe. The mechanism is arranged to reproduce the effect of the variation in the tilt of the sun above the equator with the seasons by causing the angle of tilt of shell 23 to cover, in one direction and then in the other, the entire range of values comprised between + and −23.5°. Referring once more to the drawings, it will be understood that the edge of shell 23 has two notches 29*a* and 29*b* arranged on both sides midway between hinges 27*a* and 27*b*. Notch 29*a* is clearly seen in FIG. 4, and it will be understood that notch 29*b*, which only appears in FIG. 1, is arranged symmetrically to notch 29*a*. The function of notches 29*a* and 29*b* is to allow the passage of arbor 19 when shell 23 is tilted relative to the polar axis (X-X).

Figure 4:
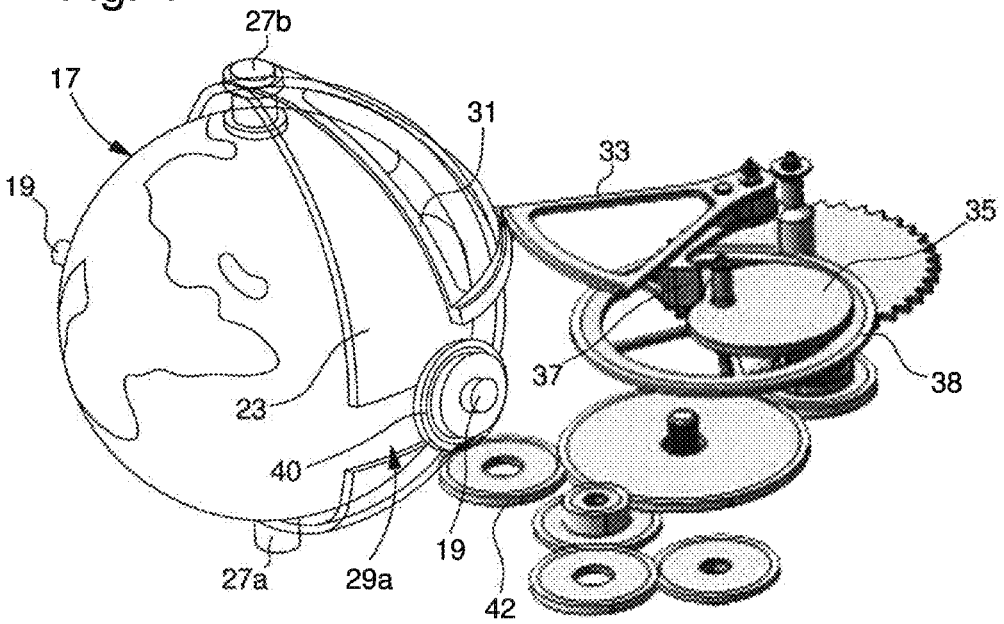
FIG. 4 is a partial, perspective view showing in more detail one portion of the sunrise and sunset indicating means.
Figure 5A:
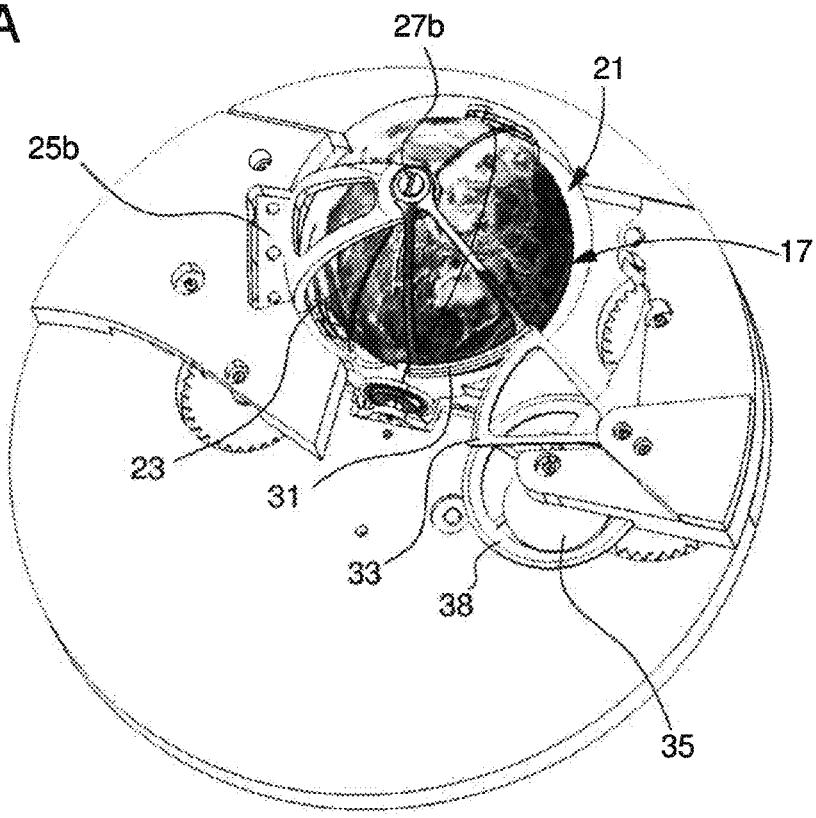
FIGS. 5A and 5B are two perspective views of the main plate of FIG. 3A respectively showing the bottom and top of the sunrise and sunset indicating means.
Figure 5B:
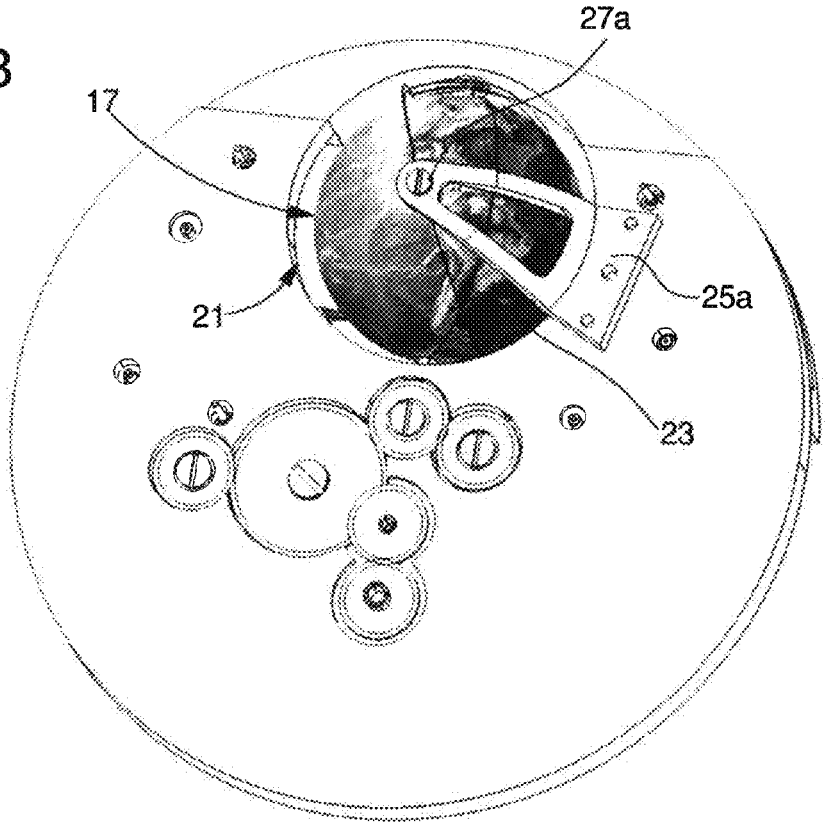

According to the invention, the mechanism provided for controlling the pivoting of the shell includes an annual cam 35 arranged to be driven in rotation by the movement at the rate of one revolution per year, and a cam follower 37 arranged to cooperate with the cam. Referring to FIGS. 4 and 5A, it can be seen that cam 35 is integral with a wheel 38. As mentioned above, the watch of the present example includes a calendar. In this example, wheel 38 is the month counter wheel of the calendar. Wheel 38 thus rotates at a rate of one revolution per year driving small hand 13 with it, so as to provide a month indication on the small dial 15 (FIG. 1). It will be understood from the foregoing that wheel 38 also drives cam 35 at the rate of one revolution per year.

FIG. 4 also shows that the second rack 33 is integral with cam follower 37. Referring again to FIGS. 3A, 3B and 4, it will be understood that shell 23 is kinematically connected to cam follower 37 by means of the two racks 31 and 33. The profile of cam 35 is representative of the tilt of the sun relative to the equatorial plane (or equally: of the tilt of the terminator plane relative to the polar axis of the terrestrial globe). When the cam profile allows cam follower 37 to drop closer to the axis of rotation of cam 35, this motion is transmitted to rack 31 via second rack 33 which is integral with the cam follower. Since shell 23 is integral with rack 31, it pivots about ecliptic axis (Y-Y), so that the mechanism is in the configuration shown in FIG. 3A. Conversely, when the cam profile raises cam follower 37 so that it moves away from the axis of rotation of cam 35, shell 23 pivots about the ecliptic axis (Y-Y) in the opposite direction, so that the mechanism is in the configuration shown in FIG. 3B.

FIG. 4 also shows a toothed wheel 40 and another toothed wheel 42. Wheel 40 is integral with arbor 19 on the south pole of the terrestrial globe, whereas wheel 42 is arranged to be driven by the movement of the watch at the rate of one revolution every 24 hours. As can be seen, wheels 40 and 42 are perpendicular to each other. Wheel 42 is arranged to drive wheel 40 via a conical gear. The gear ratio is 1. As a result of this arrangement, the watch movement can rotate the globe on itself at a rate of one revolution per day. The direction of rotation of the terrestrial globe is chosen so as to reproduce the actual movement of the Earth rotating on itself. In these conditions, the various locations on the surface of the globe move from west to east relative to the sun.

Referring again to FIG. 1, it can be seen that in the Figure, shell 23 is placed on the right side of the terrestrial globe. Further, as already mentioned, the north pole of the globe is oriented towards the top of the Figure. Thus, it can be observed that the East Coast of America is covered by shell 23 (in other words, plunged in darkness) whereas the sun illuminates the Pacific Ocean, off the West Coast. Since the visible surface of the terrestrial globe rotates from west to east, the West Coast of America will soon pass underneath the edge of the shell (whose position on the globe corresponds to that of the earth's terminator) and will also be in darkness. It is clear from the foregoing that in the configuration illustrated in FIG. 1, the dial side of the watch indicates the locations of the globe where the sun is setting. Conversely, the dial side does not provide any indication concerning locations where the sun is rising.

According to a variant of the invention, it is possible to make the watch show the locations of the globe where the sun in rising, instead of the locations where the sun is setting, simply by installing shell 23 on the left side of the terrestrial globe instead of the right side. Referring now to FIG. 2, it can be observed that the recess 21 which houses sphere 17 is a bottomless recess which passes through the frame. Further, the watch case has a transparent back cover 44 which makes it possible to observe the terrestrial globe and shell 23 from below. It will be clear that the watch illustrated can indicate the locations of the globe where the sun is setting on the dial side, and that it can indicate the places where the sun is rising on the back cover side.

Figure 6A:
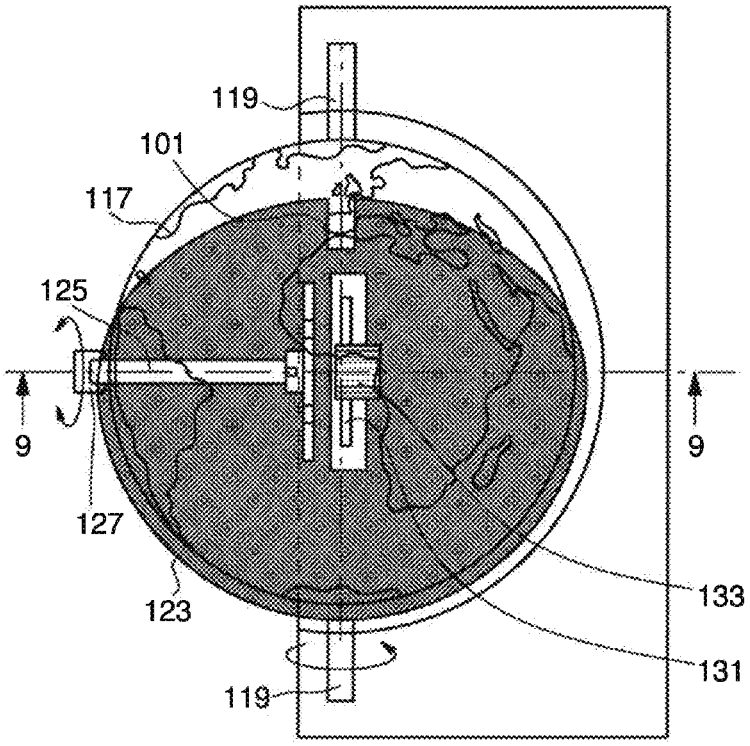
FIGS. 6A and 6B are schematic, partial cross-sections, viewed respectively from the side and from above, of the sunrise and sunset indicating means according to a second embodiment of the invention.
Figure 6B:
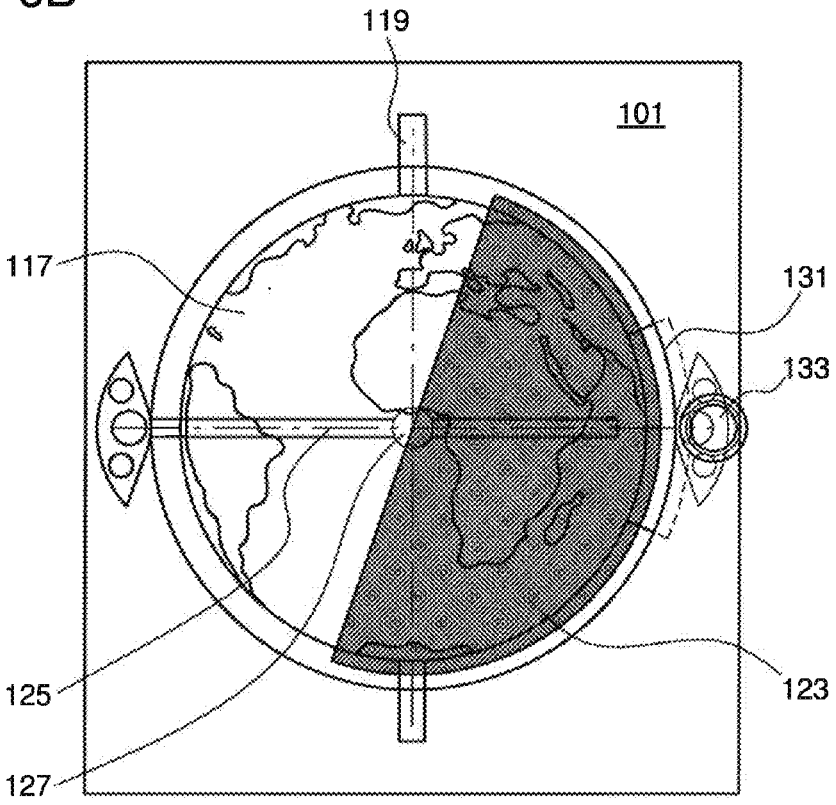

FIGS. 6A and 6B are partial, schematic, respectively side and top views of the sunrise and sunset indicating means according to a second embodiment of the invention. The indicating means shown in FIGS. 6A and 6B differ from the preceding means in that shell 123 is held by only one terminator bridge 125. As is seen in the Figures, bridge 125 is situated above dial 101 and has the shape of a relatively thin hoop which extends above the equator of terrestrial globe 117. The shell is, as it were, suspended from the hoop. Referring again to FIGS. 6A and 6B, it can be seen that in the illustrated embodiment, the tilt of the shell is not controlled via a rack, but via a straight toothed part 131 which is arranged to cooperate with a pinion 133 kinematically connected to the annual cam. It will also be clear that because the straight toothed part is arranged underneath the level of the dial, it is practically invisible.

Figure 7A:
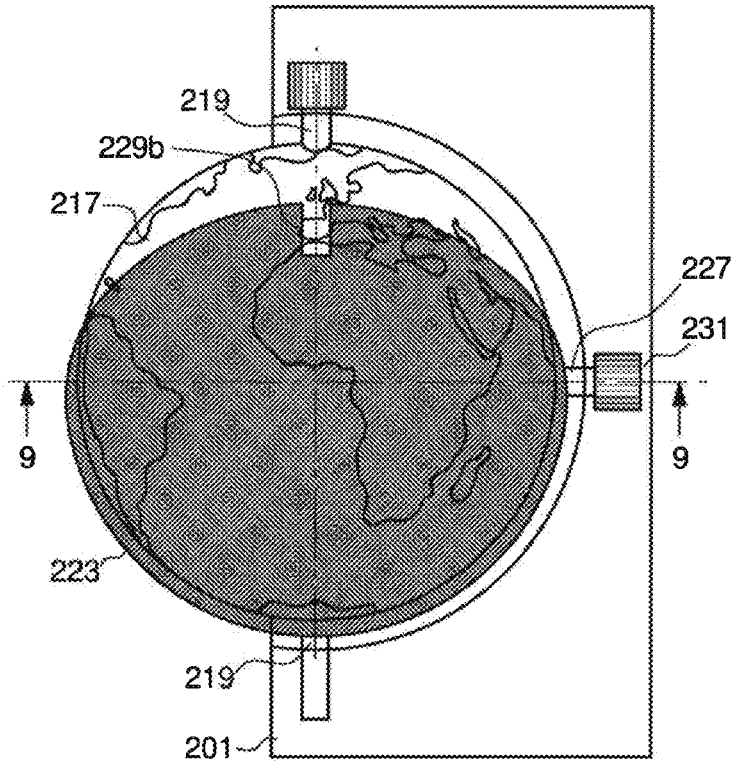
FIGS. 7A and 7B are schematic, partial cross-sections, viewed respectively from the side and from above, of the sunrise and sunset indicating means according to a third embodiment of the invention.
Figure 7B:
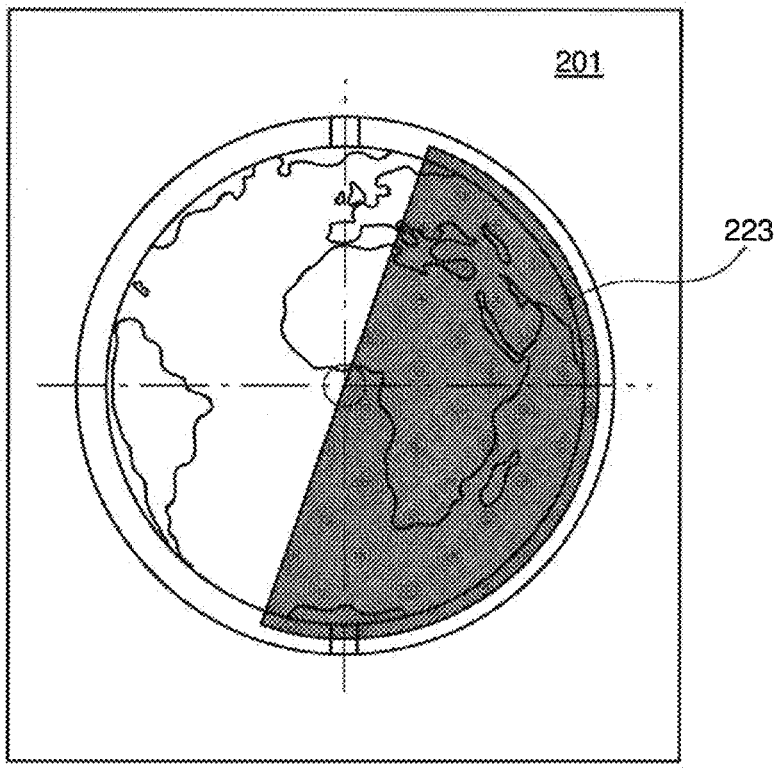

FIGS. 7A and 7B are partial, schematic, respectively side and top views of the sunrise and sunset indicating means according to a third embodiment of the invention. The indicating means shown in FIGS. 7A and 7B differ from the preceding means in that the shell 223 is a "flying" shell which is carried by a single terminator bridge (not shown) located underneath dial 201. Referring again to FIGS. 7A and 7B, it can also be seen that in the embodiment illustrated, the tilt of shell is not controlled via a rack or a straight toothed part but via a toothed wheel 231 kinematically connected to the annual cam. It will also be clear that because wheel 231 is arranged underneath the terrestrial globe, it is practically invisible.

Figure 8A:
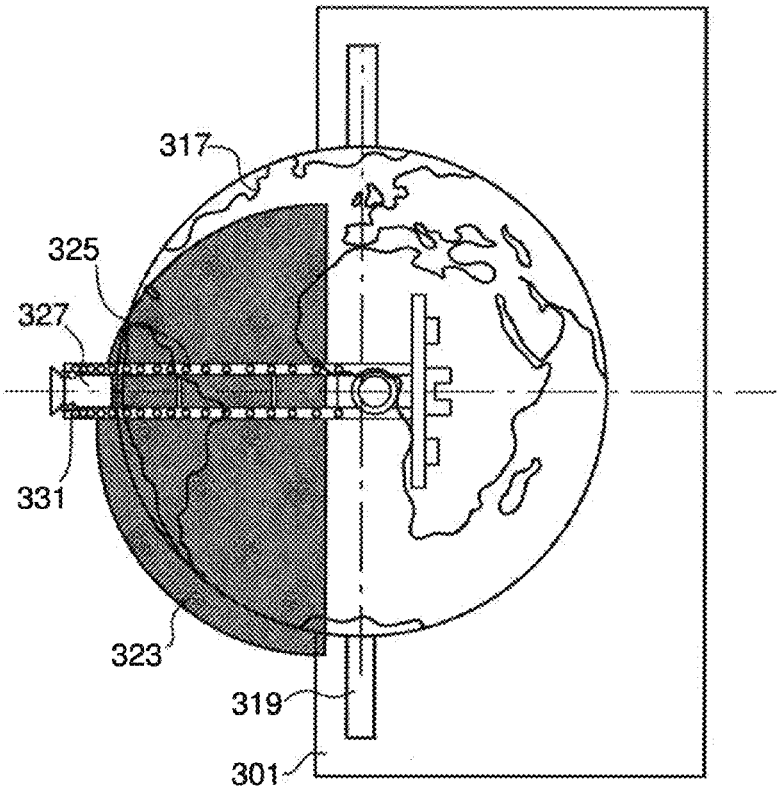
FIGS. 8A and 8B are schematic, partial cross-sections, viewed respectively from the side and from above, of the sunrise and sunset indicating means according to a fourth embodiment of the invention.
Figure 8B:
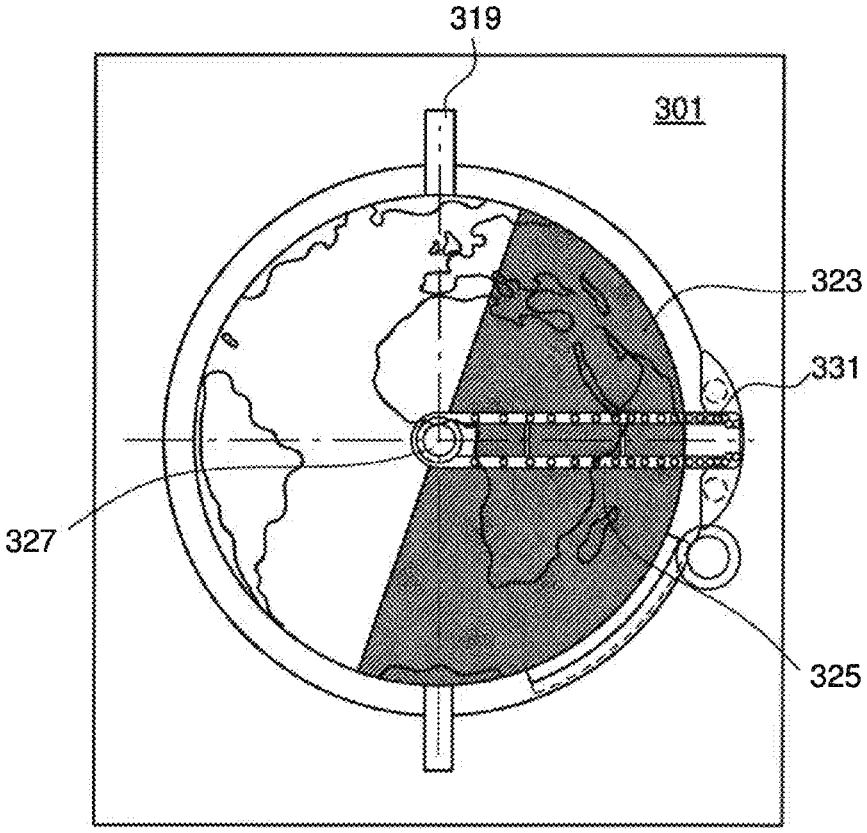

FIGS. 8A and 8B are partial, schematic, respectively side and top views of the sunrise and sunset indicating means according to a fourth embodiment of the invention. The indicating means shown in FIGS. 8A and 8B differ from those shown in FIGS. 6A and 6B in that shell 323 is truncated perpendicularly to the plane of the earth's terminator. As shown in FIG. 8A, the shell, which is suspended from bridge 325, extends to below the level of dial 301, but stops just above axis of rotation 319 of the Earth. Thus, the earth's terminator is no longer represented by a large circle, but by an arc of a circle concentric to sphere 317, which is subtended at an angle greater than 120° and less than 180°. It will be clear that this latter variant allows for a significant reduction in the required height.

Referring again to FIGS. 8A and 8B, it can also be seen that in the illustrated embodiment, the tilt of the shell is not controlled via a gear, but via a chain 331 or a belt. It will be clear that various alterations and/or improvements evident to those skilled in the art may be made to the embodiment forming the subject of this specification without departing from the scope of the present invention defined by the annexed claims. In particular, the various manners described by way of example for controlling the tilt of the shell of the sunrise and sunset indicating means are not each specific to a particular embodiment of the invention. On the contrary, different manners of controlling the tilt of the shell may be implemented with each embodiment. Further, the north pole of the terrestrial globe could be oriented downwards (in the direction of six o'clock). This arrangement makes it possible for the watch to indicate the locations on the globe where the sun is rising, instead of places where the sun is setting, while keeping the shell 23 on the right side (in FIG. 1).

What is claimed is:

1. A timepiece including a dial, a timepiece movement and means of indicating the sunrise and sunset taking account of seasonal variations, said means including a sphere reproducing the terrestrial globe, a shell arranged concentrically to the sphere and arranged to demarcate a portion of the terrestrial globe where it is night from another portion where it is day by indicating the position of the earth's terminator, the sphere being arranged to be driven by the movement so as to rotate at a rate of one revolution per 24 hours about a first axis of rotation corresponding to the polar axis of the terrestrial globe, and the shell being mounted to pivot about a second axis perpendicular to the first axis and intersecting the first axis substantially at the centre of the globe, wherein the first axis of rotation is oriented parallel to the plane of the dial and the second axis perpendicularly to the plane of the dial, wherein the sunrise and sunset indicating means also include an annual cam arranged to be driven in rotation by the movement at the rate of one revolution per year, and a cam follower arranged to cooperate with the cam, the cam having a profile representative of the tilt of the sun relative to the equatorial plane, and a kinematic connection so that the plane subtended by the earth's terminator forms, with the polar axis, an angle equal to the angle of tilt of the sun relative to the equatorial plane; and wherein the timepiece included a calendar mechanism arranged to indicate the date and the month, and wherein the annual cam is kinematically connected to the calendar mechanism.

2. The timepiece according to claim 1, wherein the timepiece is a watch.

3. The timepiece according to claim 1, wherein, above the dial, the earth's terminator indicates the locations where the sun is setting.

4. The timepiece according to claim 1, wherein, above the dial, the earth's terminator indicates the locations where the sun is rising.

5. The timepiece according to claim 1, wherein the shell arranged concentrically to the sphere carries two pivots disposed on the second axis in diametrically opposite positions, and wherein said two pivots are respectively pivoted on first and second terminator bridges of the timepiece, the first and second terminator bridges being respectively situated above and below the dial.

6. The timepiece according to claim 5, wherein the shell generally has the shape of a half sphere whose edge has two notches disposed in diametrically opposite positions midway between the two pivots.

7. The timepiece according to claim 5, wherein the terminator bridge is pierced with openings so as to increase the portion of the surface of the terrestrial globe visible at a given moment.

8. The timepiece according to claim 5, wherein the terminator bridge is made of a transparent material so as to increase the portion of the surface of the terrestrial globe visible at a given moment.

9. The timepiece according to claim 1, wherein the shell arranged concentrically to the sphere carries a pivot disposed on the second axis, and wherein said pivot cooperates with a bearing carried by a terminator bridge of the timepiece to carry the shell.

10. The timepiece according to claim 9, wherein the terminator bridge is situated below the dial, the shell then being called a "flying" shell.

11. The timepiece according to claim 10, wherein the shell generally has the shape of a half sphere whose edge has two notches disposed in diametrically opposite positions and wherein the pivot is also situated on the edge midway between the two notches.

12. The timepiece according to claim 9, wherein the terminator bridge is situated above the dial, the shell then being called a "suspended" shell.

13. The timepiece according to claim 12, wherein the shell generally has the shape of a half sphere truncated perpendicularly to the edge thereof, the pivot being situated on the edge midway between the truncated ends, the truncated edge forming an arc of a circle concentric to the sphere and subtended at an angle greater than 120° or less than 180°.

* * * * *